US005881797A

United States Patent [19]

Hansen

[11] Patent Number: 5,881,797

[45] Date of Patent: Mar. 16, 1999

[54] MOULD-PRESSING MACHINE WITH LIQUID-MIST INJECTION

[75] Inventor: Ole Oksby Hansen, Ballerup, Denmark

[73] Assignee: George Fisher Disa A/S, Herlev, Denmark

[21] Appl. No.: 981,854

[22] PCT Filed: Nov. 15, 1996

[86] PCT No.: PCT/DK96/00471

§ 371 Date: Jan. 2, 1998

§ 102(e) Date: Jan. 2, 1998

[87] PCT Pub. No.: WO97/19773

PCT Pub. Date: Jun. 5, 1997

[30] Foreign Application Priority Data

Nov. 30, 1995 [DK] Denmark ..... 1353/95

[51] Int. Cl.[6] ..... B22C 15/00; B22C 19/00; B22C 23/02

[52] U.S. Cl. ..... 164/187; 164/149; 164/267

[58] Field of Search ..... 164/187, 149, 164/267

[56] References Cited

U.S. PATENT DOCUMENTS

| | | | |
|---|---|---|---|
| 4,541,473 | 9/1985 | Onoe et al. . | |
| 4,758,142 | 7/1988 | Voss et al. . | |
| 5,582,227 | 12/1996 | Schuch et al. | 164/149 X |

FOREIGN PATENT DOCUMENTS

| | | | |
|---|---|---|---|
| 0 642 837 | 3/1995 | European Pat. Off. . | |
| 44 42 846 | 6/1985 | Germany . | |
| 285033 | 12/1990 | Germany | 164/267 |
| 1-31554 | 2/1989 | Japan . | |
| 1452642 | 1/1986 | U.S.S.R. | 164/267 |
| WO89/02937 | 4/1989 | WIPO . | |

OTHER PUBLICATIONS

Derwent's Abst., No. 95–2063222/27, week 9527, JP 5–270383, Oct. 28, 1993.

*Primary Examiner*—J. Reed Batten, Jr.
*Attorney, Agent, or Firm*—Larson & Taylor

[57] ABSTRACT

In a mould-pressing machine, atomizing nozzles with a vortex chamber deliver atomized liquid mixed with air through outlet apertures. The atomizing air nozzle or nozzles are constantly supplied with compressed air through a pressure conduit while the liquid nozzle solely receives liquid under pressure through a liquid channel and a slave valve controlled by the liquid pressure in the periods during which injection of liquid mist is desired. A first (upstream) vortex chamber is provided upstream of a second (downstream) vortex chamber, and between these two vortex chambers a flow path is provided to interconnect the two vortex chambers, through which flow path the liquid mist having been formed in the first vortex chamber is forced to pass and change its direction and velocity of flow at least one, thus reducing the droplet size of the liquid mist.

9 Claims, 4 Drawing Sheets

MOULD-PRESSING MACHINE WITH LIQUID-MIST INJECTION

TECHNICAL FIELD

The present invention relates to a mould-pressing machine with liquid-mist injection via at least one spray nozzle. The machine is suitable for producing parts by compacting particulate material, especially mould sand, and includes:

a) a mould chamber bounded by at least one mould-chamber wall;

b) filling means for filling particulate material into the mould chamber;

c) pressing-force means adapted to move at least one mould-chamber wall towards at least one other mould-chamber wall so as to compact particulate material therebetween; and d) liquid mist-applying means adapted to introduce a liquid mist into the mould chamber prior to the mould chamber being filled with particulate material by means of said filling means, said liquid mist being formed by at least on atomizing nozzle in which a liquid supplied under pressure is atomized by means of an air current, said atomizing nozzle comprising:

d1) a second vortex chamber having at least one outlet aperture for a liquid-in-air dispersal, d2) at least one first nozzle aperture positioned upstream of said outlet aperture for supply of the liquid, d3) at least one second nozzle aperture positioned upstream of said outlet aperture in the immediate vicinity of said first nozzle aperture for supply of atomizing air, and d4) a valve adapted to shut off said first nozzle aperture and having a valve member spring-biased towards the closed position and capable of being moved away form said closed position under the influence of pressure in liquid supplied to said first nozzle aperture;

e) air supply means for supplying atomizing air under pressure to said second nozzle aperture or apertures;

f) pressure-creating means for applying pressure to liquid supplied to said first nozzle aperture or apertures solely during the periods during which production of said liquid mist is desired.

BACKGROUND ART

Mould-pressing machines of the kind referred to above are e.g. known from U.S. Pat. Nos. 5,494,094 and 4,791,974.

In mould-pressing machines of the kind referred to above, usually being adapted to operate automatically producing series of casting moulds or casting-mould parts, it is of crucial importance that the correct quantity of liquid mist be injected in each cycle. Thus, an excess of liquid mist will, in addition to increasing the costs, create an unnecessary load on the environment, while too small quantities of liquid mist will result in an insufficient "lubrication" of the mould-chamber walls, in the worst case possibly causing parts of the compacted object to stick to the patterns mounted on the mould-chamber walls and thus make the mould part unsuitable for pouring.

Thus, it is desirable to inject the least possible quantity of liquid with the liquid mist, while at the same time ensuring with absolute certainty that the mould is lubricated sufficiently.

It is a relatively simple matter to ensure that the quantity being supplied to the system in each operating cycle is held below a predetermined upper limit, this effect e.g. being attainable by means of a suitably time-controlled and cycle-controlled pump only applying pressure to the liquid to be atomized in a period corresponding to the desired quantity of liquid mist for each operating cycle. Thus, the maximum quantity of liquid that it is possible to advance through the liquid path with a given pressure at a given moment in time sets the upper limit for the quantity of liquid.

On the other hand it can, however, be difficult to set the lower limit for the quantity of liquid being supplied to the liquid mist, a number of relationships coming into play. Thus, it is of primary importance that the liquid quantity being supplied is converted into a uniform liquid mist being distributed uniformly on the mould chamber walls, so that a sufficient quantity of liquid will be deposited on these walls to provide the requisite lubrication. If the nozzle aperture or other parts of the nozzle are contaminated by particulate mould material or other particles, this will have a negative effect on the formation of the liquid mist and the quantity of liquid being introduced into the mould chamber.

For this reason, the prior art referred to initially comprises the use of nozzles, in which it is possible to maintain a continuous air stream through the outlet aperture, making it difficult for particles from the mould chamber to penetrate into the apertures.

In these nozzles, the liquid mist is formed by liquid being injected from a first nozzle aperture into a vortex chamber, in which it is mixed with the atomizing air being blown into the vortex chamber from a second nozzle aperture, after which the liquid mist is discharged from the outlet aperture or apertures.

With this known technology, it has been difficult to form a liquid mist with fine and uniform droplets. In the prior art this makes it necessary to supply more liquid to the liquid mist than would have been necessary, if the liquid mist were more uniform and had finer droplets.

Further, it has been necessary to use relatively complex valves for shutting-off the liquid at the first nozzle aperture, because this valve is of substantial importance for the accuracy and precision with which the liquid can be delivered to the vortex chamber. It has, however, frequently been necessary to supply a greater quantity of liquid in order to compensate for inaccuracies and lack of precision in the delivery of the liquid. In addition to this, the possibility of liquid leaks occurring, e.g. due to particles—in spite of the continuous stream of air—having penetrated from the mould chamber and in through the outlet aperture to the shut-off valve at the nozzle aperture, has made it necessary to construct the valve in a complicated manner in order to safeguard the operation, and to supply a greater amount of liquid in order to compensate for possible leaks, respectively.

DISCLOSURE OF THE INVENTION

On this background, it is the object of the present invention to indicate the construction of a mould-pressing machine of the kind referred to above having a vortex chamber (hereinafter referred to as a "downstream" or "second" vortex chamber) and having said first and second nozzle apertures for supply of, respectively, liquid and atomizing air, with which it is possible not only to set an upper limit for the amount of liquid mist being injected into the mould chamber during each cycle, but also to set a reliable lower limit for this amount and reduce the quantity of liquid that it is necessary to supply to the liquid mist in each operating cycle, and this object is achieved by providing a further vortex chamber of the downstream vortex chamber mentioned above (the further vortex chamber being hereinafter referred to as a "first" or "upstream" vortex chamber) and downstream of the first and second nozzle apertures mentioned above. The upstream and downstream vortex chambers are connected by a flow path with a reduced cross-sectional area which is shaped to produce at least on change in direction of flow in the flow between the two vortex chambers. With this arrangement, the liquid mist will be formed with finer droplets, and it will be more difficult for particles to penetrate from the outlet aperture or apertures in the upstream direction to the first nozzle aperture, the latter advantage again making it possible to relax the demands on the shut-off valve and its construction, and it will not be necessary to use the full atomization air pressure during the periods in which spray mist is not being formed in order to protect the first nozzle aperture against intruding particles.

Even though the first and the second vortex chambers as well as the flow path referred to may in so far be shaped in any manner, it is preferred that the first vortex chamber extends substantially coaxially with the first nozzle aperture and that the flow path from the first vortex chamber comprises substantially radical holes debouching in an annular chamber and a gap or number of grooves in a substantially axial peripheral surface debouching in the second vortex chamber.

A preferred arrangement in which the first vortex chamber is formed in a body as an axial bore open at one end makes it possible in a simple manner to manufacture, dismantle and clean the nozzle with the two vortex chambers, as well as to alter the nozzle characteristics by exchanging the body referred to with another.

By constructing the nozzle with its associated shut-off valve in the form of a non-return valve located near the first nozzle aperture it is possible to achieve a simple construction of the valve with low inertia and friction.

Altogether, the construction of the machine according to the invention, including i.a. the use of two vortex chambers in the spray nozzles, makes it possible to provide a machine of simpler construction and capable of in a safe and reliable manner producing a liquid mist with fine and homogeneous droplets whilst consuming less liquid than the previously known equipment. The use of two vortex chambers in each spray nozzle contrasts with the usual design philosophy in this field, because the normal practice is to construct the nozzles in the simplest possible manner to make replacements less costly and simplify the cleaning.

BRIEF DESCRIPTION OF THE DRAWINGS

In the following detailed part of the present description, the invention will be explained in more detail with reference to the exemplary embodiments of the relevant parts of a mould-pressing machine according to the invention shown in the drawings, in which.

DESCRIPTION OF THE PREFERRED EMBODIMENT

Figure 1:
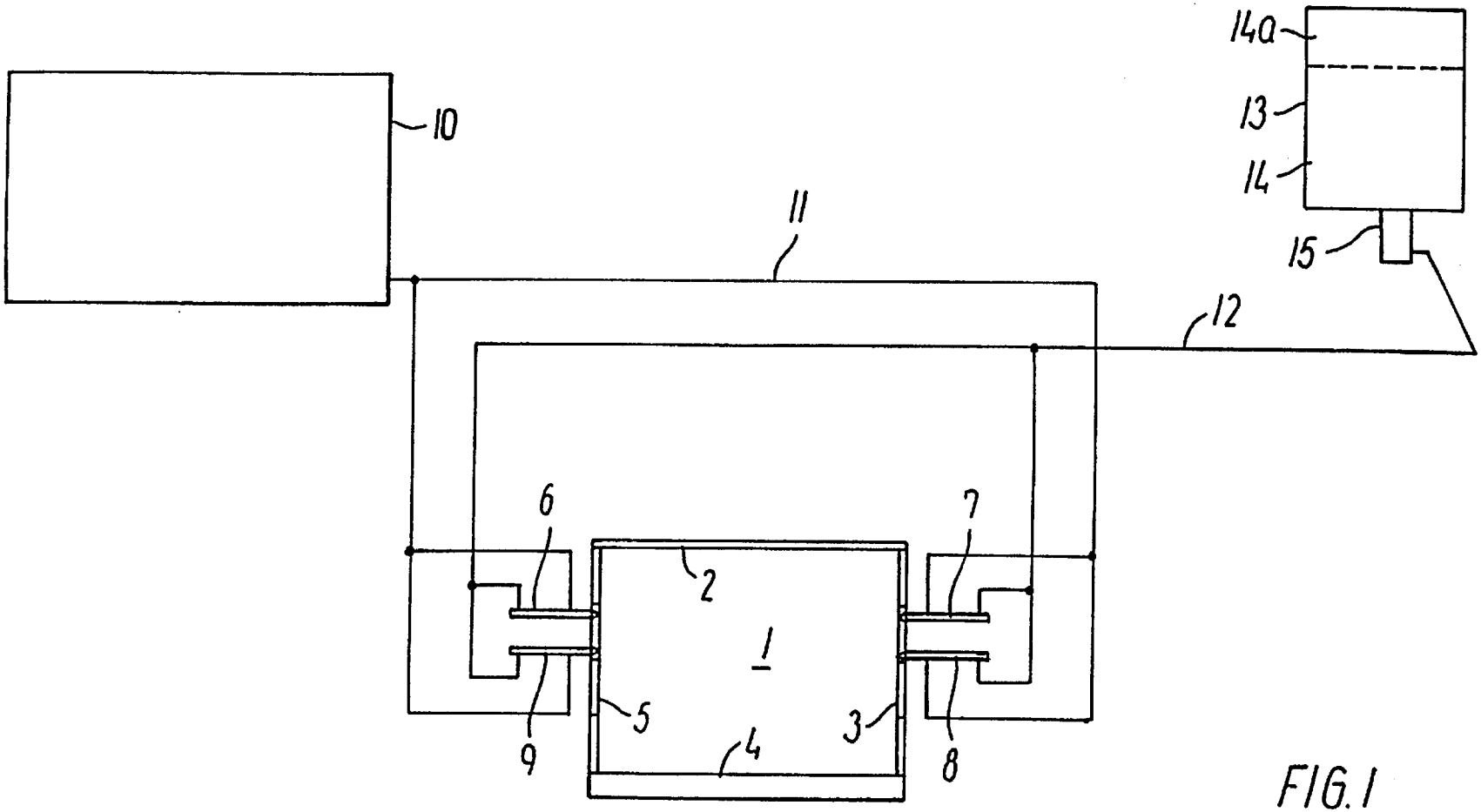
FIG. 1 is an overall view showing only those parts of the mould-pressing machine according to the invention with associated equipment necessary for the understanding of the invention.

The drawing shows solely those parts of a mould-pressing machine with associated auxiliary equipment necessary for the understanding of the invention. As persons skilled in this art will know, a mould-pressing machine of the kind here referred to requires for its operation various further means and mechanisms, the construction of which and co-operation of which with the components shown will be known to these persons.

Thus, FIG. 1 shows a mould chamber 1 bounded by four walls 2–5 visible in FIG. 1, as well as by two further walls (not shown) situated in front of and behind the plane of the drawing, respectively. At least one of these walls, constituting the pattern-carrying wall or one of such walls, is adapted to be moved relative to the remaining walls in such a manner, that particulate material, e.g. mould sand, may be compacted in the mould chamber 1 by the pattern carrier or carriers, so as in a manner known per se to form a casting-mould part corresponding to the pattern impression.

To prevent the mould sand from adhering to the patterns mounted on the two walls mentioned but not shown, a suitable liquid mixed with air is injected through a number of, in the example shown four, nozzles 6–9 of mutually identical construction.

In the example shown, compressed air is constantly being supplied to the nozzles 6–9 from a compressed-air source 10 through a branched compressed-air conduit 11. The liquid is supplied from the liquid space 14 in a liquid reservoir 13 through a time-controlled pump 15 and a branched liquid conduit 12 to the nozzles 6–9.

Figure 2:
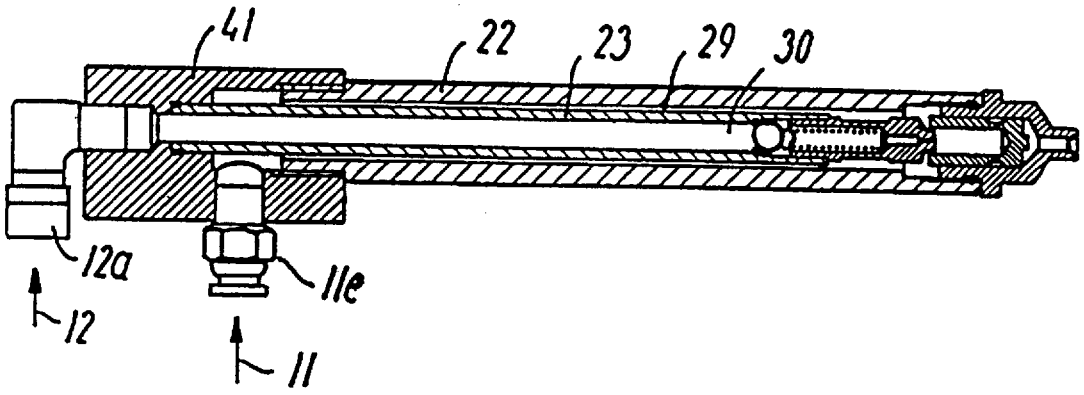
FIG. 2 is a longitudinal sectional view of a nozzle used in the machine according to the invention, FIG. 3 at an enlarged scale shows the forwardmost part of the nozzle shown in FIG. 2, showing the nozzle head and the valve according to the invention, and FIG. 4 diagrammatically shows an exemplary embodiment of a system of components, according to the invention advantageously being used for controlling and regulating the supply and pressure of liquid and air for the nozzles.
Figure 3:
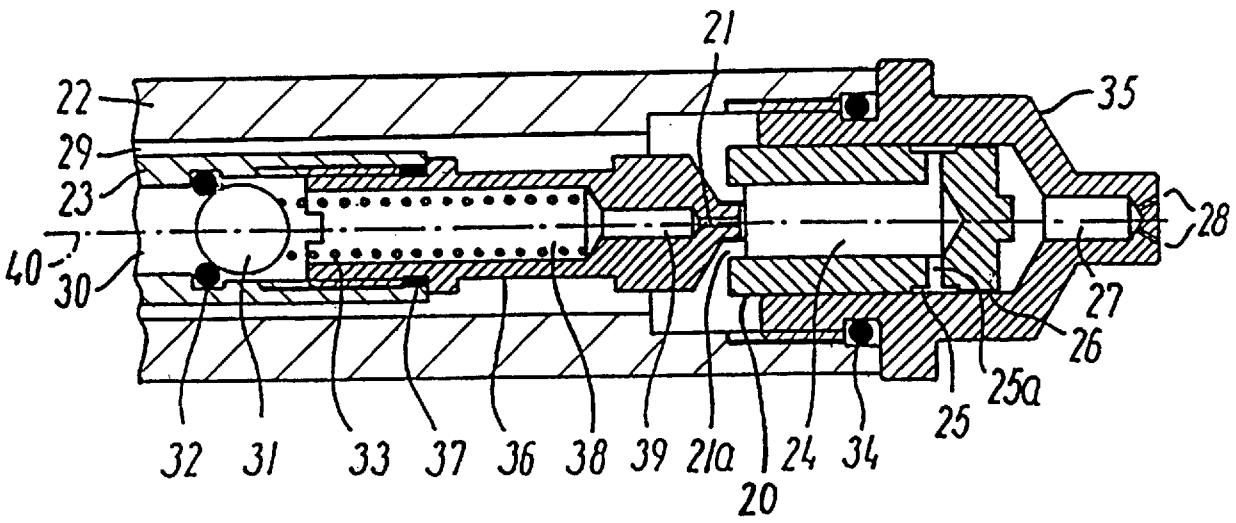

The mode of operation of the nozzles 6, being—of course—identical to the mode of operation of the remaining nozzles 7–9, is explained below with reference to FIGS. 2 and 3.

The air is supplied via the connector 11*e* to the air channel 29 formed between the outer tube 22 and the inner tube 23. The liquid is supplied via the liquid connector 12*a* into the liquid channel 30 constituted by a central bore in the inner tube 23. The liquid channel 30 leads to the valve means 31–33. In the example shown, this valve means is formed by the valve seat 32 constituted by an elastic O-ring, against which the valve body in the form of a ball 31 lies in abutment biased by a spring 33. This valve means constitutes a non-return valve ensuring that the liquid can only flow forward to the liquid-nozzle aperture 21 constituting the first nozzle aperture, from which the liquid cannot flow back into the liquid channel 30 because of the valve means. If a sufficiently high pressure is applied to the liquid in the liquid channel 30 to overcome the elastic force acting upon the valve member 31 by the spring 33, liquid will flow from the liquid channel 30 in through the valve seat 32 past the valve member 31 and continue in the forward direction through the liquid-nozzle housing 36 through bores 38,39 to the liquid nozzle 21, from where it is ejected into the first (upstream) vortex chamber 24. This preferred form of valve construction is extremely simple and robust.

The first bore 38, being open outwardly at the end facing the valve member 31, constitutes both a liquid channel and a spring housing for the spring 33, and the ledge at the transition from the bore 38 to the bore 39, the latter having a smaller diameter than the former, constitutes the seat for the spring 33. The liquid-nozzle housing 36 is preferably made in one piece and secured to the inner tube 23 by means of a threaded connection or other securing means, and the connection between the liquid-nozzle housing 36 and the inner tube 23 may be sealed with an O-ring 37. As will be evident from the drawing, the liquid-nozzle housing 36 can be manufactured in a simple manner, e.g. by means of axial boring and other machining operations. It is also evident from the drawing that when the liquid-nozzle housing 36 is removed from the inner tube 23, the valve components 31 and 33 are immediately accessible for removal, and the O-ring 37 can be extracted making it easy to clean all these components.

The air channel 29, in the example shown extending coaxially about the liquid-nozzle housing 36, debouches in an air-nozzle aperture 21*a* constituting the second nozzle aperture and being situated coaxially about the liquid-nozzle aperture 21.

When pressure is applied to the liquid and the air, they will flow out through the first and the second nozzle aperture 21 and 21*a,* respectively, and be intermixed in the first vortex chamber 24 so as to form a liquid mist. At the end of the first vortex chamber 24, formed in the vortex-chamber body 20, the liquid mist flows radially outwardly through holes 25*a* formed in the body 20 to the annular chamber 25. From the annular chamber 25, the liquid mist flows in the forward direction through a gap 26 or grooves 26, formed in a peripheral surface on the body 20 at the end facing away from the entrance opening to the first vortex chamber 24, and from the gap or the grooves 26, the liquid mist flows into the second downstream vortex chamber 27.

As mentioned above, the connection between the annular chamber 25 and the second vortex chamber 27 may be constituted by either a coaxial gap 26 or grooves 26. If grooves 26 are used, they can extend in a more or less helical manner, so as to produce cyclone-like vortices in the second vortex chamber 27.

From the second vortex chamber 27, the liquid mist flows in the forward direction to the exit aperture 28, in the example shown being formed by fine holes 28 situated symmetrically about a nozzle axis 40, and the holes 28 extend at a skew angle so as to substantially lie in a surface of a cone about the axis 40. From the holes 28, the liquid mist is sprayed out into the mould chamber 1.

When the liquid from the liquid nozzle 21 is ejected into the first vortex chamber 24 and is mixed with the atomizing air from the air nozzle 21*a,* a liquid mist is formed having substantially the same droplet size and uniformity as are formed with the previously known nozzles of this kind. After this, the liquid mist undergoes an additional atomization by passing through the flow path formed by the radial holes 25*a,* the annular chamber 25 and the gap or grooves 26, ending at the internal end wall of the second vortex chamber 27. By passing through this flow path past obstructions producing velocity and pressure variations, wall friction, turbulence and collisions of heavier droplets with the walls, the droplet size of the mist is reduced and made more uniform than can be achieved with one single vortex chamber.

In normal operation, air flows continuously through the air channel 29 and through the vortex chambers 24, 27 via the flow path 25, 25*a,* 26 and out through the fine holes 28, thus ensuring that the nozzle will not be clogged by particles from the mould chamber 1. Should, however, a large pressure rise occur in the mould chamber 1, such as may happen when filling mould material into the mould chamber 1, particles can penetrate inwardly through the holes 28 and into the second vortex chamber 27. It will, however, be difficult for the particles to penetrate from the second vortex chamber 27 into the first vortex chamber 24, because the flow path 25, 25*a,* 26 constitutes an obstacle more difficult for the heavier particles than the air to pass, and due to their weight, these heavier particles will hit the walls and be retarded each time the flow path changes direction, thus preventing particles from being shot into the first vortex chamber with a high velocity. Substantially at the same time, a pressure wave will travel through the air channel 29, thus reducing the risk for the liquid-nozzle aperture 21 of being contaminated with particles from outside. One of the effects of this is that the shut-off valve for the liquid-nozzle aperture 21 need not be constructed in a particularly contamination-resistant manner, for which reason it can be constructed in the simple manner of a non-return valve as referred to above. This arrangement makes it possible to construct the liquid path in the forward direction to the valve 31–33 in any desirable manner, and makes it possible to construct the valve body with a low inertia and friction, complex connecting devices, increasing the weight and the possibility of friction, not being necessary. Further, the non-return valve 31–33 delimits the volume, from which liquid can leak during the intervals in which spray mist is not to be formed, substantially to the volume constituted by the bores 38, 39 in the liquid-nozzle housing 36, thus reducing the loss of liquid.

Since the risk and the possibility of particles from the mould chamber 1 penetrating into the innermost parts of the nozzle 6 are reduced, it is also possible to lower the pressure in the air channel 29 in the periods in which spray mist is not to be formed, because the air pressure only periodically needs to be sufficiently high to be able to blow the exit apertures 28 clean.

In order to simplify manufacture and cleaning, the vortex-chamber body 20 can be made in one piece to be inserted in the nozzle-outlet housing 35, likewise being made in one piece. Further, the nozzle-outlet housing 35 can be removably secured to the outer tube 22 of the nozzle 6, e.g. by means of a threaded connection or the like, the connection between the nozzle-outlet housing 35 and the outer tube 22 being sealed with a seal 34, preferably in the form of a flexible O-ring.

If likewise, the outer tube 22 and inner tube 23 are removably mounted, e.g. by means of a threaded connection, in a nozzle-mounting housing 41, it is possible to dismantle the nozzle 6 into its individual components, making it possible in a simple manner to clean, exchange and alter these components.

Figure 4:
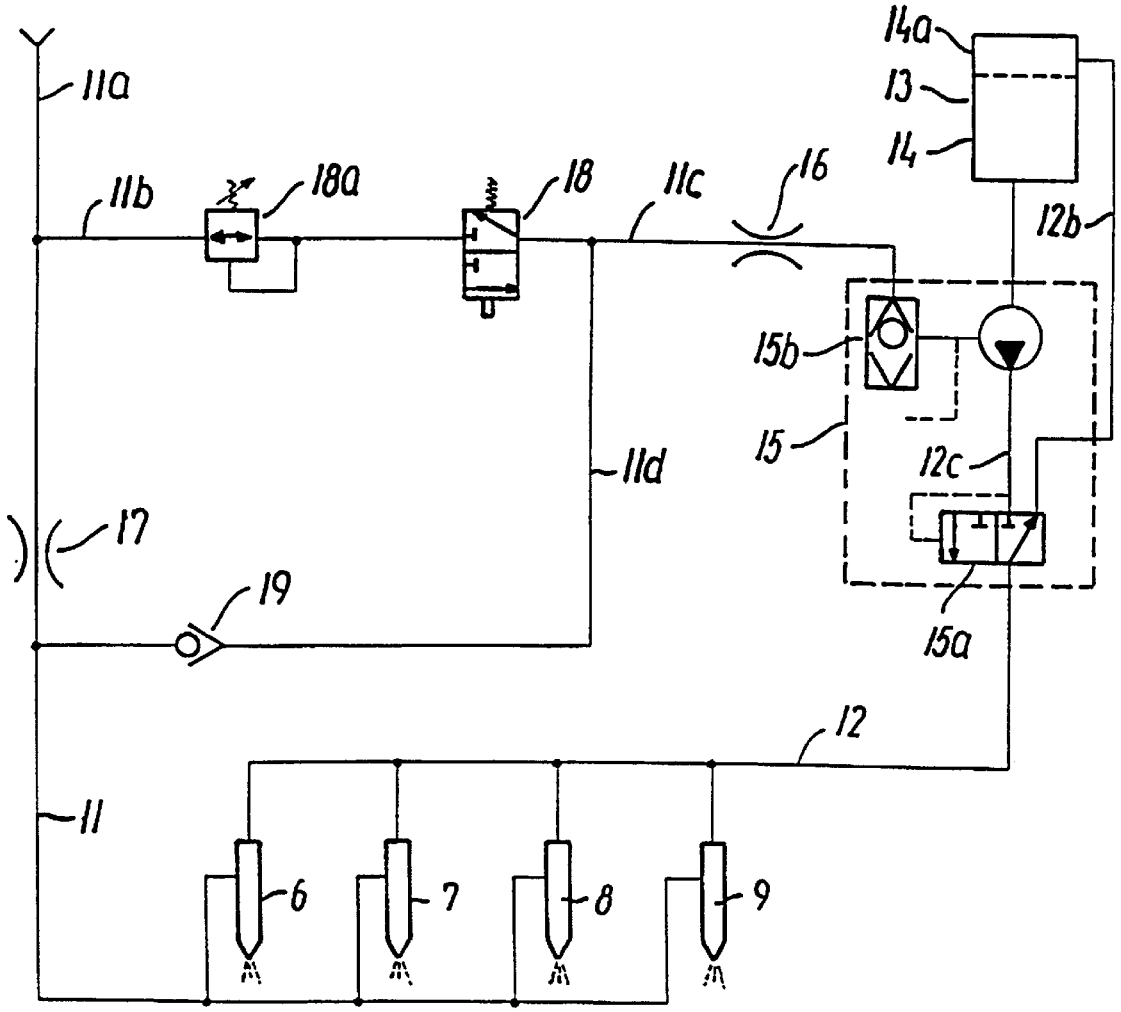

Since the machine according to the invention does not require a continuous supply of air under pressure to the spray nozzles 6–9, the machine can advantageously be constructed with an intermittent supply of air under pressure to the nozzles 6–9, this e.g. being achieved by constructing the parts of the machine in the manner shown in FIG. 4.

In FIG. 4, compressed air is received from a compressed-air source to the compressed-air conduit 11*a*. The compressed-air conduit 11*a* is connected to a compressed-air branch conduit 11*b,* the latter leading via a reducing valve 18*a* and a controlled valve 18, preferably a solenoid valve, to a branching point, at which the compressed-air conduit forms two branches, viz. a compressed-air conduit 11*c* and a compressed-air conduit 11*d.*

The compressed-air conduit lid leads via the non-return valve 19 to the compressed-air conduit 11 supplying compressed air to the nozzles 6–9. Further, the compressed-air conduit 11 is connected to the compressed-air supply conduit 11*a* through a restricted orifice 17, so that when compressed air is supplied to the compressed-air supply conduit 11*a,* it is also ensured via the restricted orifice 17 that compressed air is supplied to the compressed-air conduit 11 and the nozzles 6–9.

The compressed-air branch conduit 11*c* leads to a pump 15 via a restricted orifice 16, said pump 15 being controlled and possibly actuated by compressed air. This pump builds up the liquid pressure in the liquid conduit 12 leading to the spray nozzles 6–9 by pumping liquid from a liquid space 14 in a liquid reservoir 13 to a liquid conduit 12. The flow path between the pump 15 and the liquid conduit 12 may comprise a pressure-controlled switching valve 15*a,* reacting on the presence of a higher pressure in the liquid conduit 12 to the spray nozzles 6–9 than the pressure from the pump in the conduit 12*c* by shutting off the latter and switching the liquid conduit 12 from the conduit 12*c* to a liquid conduit 12*b* returning liquid to the liquid reservoir 13 and the latter's upper part comprising an air space 14*a* above the liquid space 14.

The pressure-controlling parts of the machinery shown in FIG. 4 function in the following manner. The starting point is the part of the machine cycle, in which liquid mist is not to be formed, the solenoid valve 18 for this reason being closed. A compressed-air source 10 shown in FIG. 1 supplies compressed air to the compressed-air supply conduit 11*a*. From the latter, the compressed air is supplied via the restricted orifice 17 at a reduced pressure to the compressed-air conduit 11, from which the compressed air is supplied to the spray nozzles 6–9 so as to provide a continuous flow of compressed air through the nozzles and into the mould chamber 1 shown in FIG. 1.

When the machine operating cycle approaches the moment in time, at which a spray mist is to be formed, the solenoid valve 18 opens immediately before this mist is to be formed. This causes a pressure, previously having been adjusted on the reducing valve 18*a,* to propagate in the forward direction to the branch conduit 11*c,* 11*d*. The compressed air with the pre-adjusted pressure is conducted by the compressed-air conduit 11*d* via the non-return valve 19 to the compressed-air conduit 11, the pressure in the latter being built up toward a value determined by the setting of the reducing valve 18*a,* and this pressure build-up propagates to the spray nozzles 6–9, thus causing the flow-through of air in these to be built up to a desired value.

At the same time as a build-up of the pressure in the compressed-air conduit 11 takes place, a build-up of air pressure takes place in the compressed-air-controlled pump 15 via the restricted orifice or throttling device 16. The throttling device 16 produces a delay of the build-up of air pressure at the compressed-air-controlled pump 15, and this delay is harmonized with the delay taking place in the build-up of air pressure to the spray nozzles 6–9. When the pressure at the compressed-air-control pump 15 reaches a switching-threshold value, the pump 15 starts and builds up a pressure in the liquid conduit 12*c,* 12, during which the liquid conduit 12*c* is possibly connected to the liquid conduit 12 by a switching valve 15*a,* if the connection between the liquid 12*c* and the liquid conduit 12 has been interrupted. This liquid pressure propagates so to speak without delay through the liquid conduit to the spray nozzles 6–9, the latter then producing a liquid mist as described previously and being sprayed in the mould chamber.

During this course of events, the solenoid valve 18 is subjected to a control, e.g. a time control or a control on the basis of measurement of the liquid flow in the liquid conduit producing a signal for closing the solenoid valve 18. When the solenoid valve 18 is closed, the pressure in the compressed-air conduits 11*c* and 11*d,* that are relatively short, falls relatively quickly, causing the non-return valve 19 to close and the pump 15 to stop. In this manner, the liquid flow to the spray nozzles 6–9 ceases without substantial time delay, whereas the air pressure in the air conduit 11 falls gradually to its previous value as the air is being discharged via the spray nozzles 6–9.

By arranging the pressure control in the manner referred to above it is possible using simple means to provide control of the quantity of liquid being supplied to the spray nozzles 6–9, and this metering of liquid may be carried out using simple time control or other means. At the same time it is possible to adjust both the pressure of the atomizing air and the pressure in the liquid for forming the liquid mist by a single setting of the reducing valve 18*a*. It is thus possible in a simple manner to make the liquid pressure proportional to the pressure of the atomizing air. Further, when the pressure in the compressed air supplied to the spray nozzles 6–9 varies intermittently, it is permissible to use pressures for the formation of liquid mist producing such outlet pressures and velocities from the spray nozzles 6–9 that could cause damage to the moulds being formed in the mould chamber in the regions of the outlet apertures of the spray nozzles 6–9, because prior to the formation of a new mould, this pressure is lowered to a level at which damage cannot be caused to the newly introduced mould material or the finished mould being present in the mould chamber. Thus, it is possible in a simple manner to achieve an intermittently varying pressure for the atomizing air, co-ordinated in time with the pressure in the liquid being supplied to the first nozzle with the pressure in to vary the pressures of the liquid and the air using the same adjustment means. It is also possible to achieve a time delay in the generation of pressure at the controlled pump and hence in the liquid-conducting conduit, and the delivery of the liquid from the first nozzle aperture to the first vortex chamber, it being possible to adapt said delay to compensate for the delay arising in the atomizing-air conduit and at the delivery of the atomizing air from the second nozzle aperture.

A more detailed description of the equipment (not shown), that the mould-pressing machine according to the invention must comprise or be associated with, such as filling means for filling particulate material in the mould chamber and pressing-force means to move at least one mould-chamber wall towards at least one other such in order to compress the particulate material and to eject the finished mould, may be found in U.S. Pat. Nos. 4,791,974 and 5,494,094, and the spray nozzles and the liquid-return arrangement may be constructed in the manner described in U.S. Pat. No. 5,494,094, the content of these documents to be considered part of the present description to the extent to which they comprise such a description.

I claim:

1. Mould-pressing machine for producing parts by compacting particulate material, comprising:

a) a mould chamber bounded by at least one mould-chamber wall;

b) filling means for filling particulate material into the mould chamber;

c) pressing-force means adapted to move at least one mould-chamber wall towards at least one other mould-chamber wall so as to compact particulate material therebetween; and d) liquid mist-applying means adapted to introduce a liquid mist into the mould chamber prior to the mould chamber being filled with particulate material by means of said filling means, said liquid mist being formed by at least one atomizing nozzle in which a liquid supplied under pressure is atomized by means of an air current, said atomizing nozzle comprising:

d1) a second vortex chamber having at least one outlet aperture for a liquid-in-air dispersal, d2) at least one first nozzle aperture positioned upstream of said outlet aperture for supply of the liquid, d3) at least one second nozzle aperture positioned upstream of said outlet aperture in the immediate vicinity of said first nozzle aperture for supply of atomizing air, and d4) a valve adapted to shut off said first nozzle aperture and having a valve member spring-biased towards the closed position and capable of being moved away from said closed position under the influence of pressure in liquid supplied to said first nozzle aperture;

e) air supply means for supplying atomizing air under pressure to said second nozzle aperture or apertures;

f) pressure-creating means for applying pressure to liquid supplied to said first nozzle aperture or apertures solely during the periods during which production of said liquid mist is desired; and g) a first vortex chamber downstream of said first and second nozzle apertures and upstream of said second vortex chamber, said first and said second vortex chambers being connected by a flow path with a reduced flow cross-sectional area and being shaped to produce at least one change in the direction of flow in the flow between the first and second vortex chambers.

2. Machine according to claim 1, wherein said first vortex chamber extends substantially coaxially with said first nozzle aperture, and wherein the flow path from said first vortex chamber comprises substantially radial holes debouching in an annular chamber, and a gap or a number of grooves situated in a substantially axial peripheral surface and debouching in said second vortex chamber.

3. Machine according to claim 2, wherein said first vortex chamber is formed in a body as a substantially axial bore open at one end and, adjacent to its opposite end, having said substantially radially emerging bores debouching in said annular chamber, said body having an outer diameter in magnitude within an interval limited by the bottom diameter and the largest edge diameter of said annular chamber, or of said gap or grooves extending from said annular chamber and away from said open end of said bore.

4. Machine according to claim 1, wherein said valve means for shutting off said first nozzle aperture comprises a non-return valve arranged in the vicinity of the first nozzle aperture.

5. Machine according to claim 4, wherein said non-return valve comprises:

a valve seat situated close to and upstream of said first nozzle aperture through which a liquid channel passes on its way to said first nozzle aperture; and b) a valve member situated between said first nozzle aperture and said valve seat and being biased towards the latter.

6. Machine according to claim 5, wherein said first liquid-nozzle aperture comprises a one piece liquid-nozzle housing forming a removable closure for said liquid channel, said non-return valve means being retained between said liquid-nozzle housing and said valve seat.

7. Machine according to claim 1 further comprising a compressed-air-controlled pump for applying pressure to liquid supplied to said first nozzle aperture or to air supplied to said second nozzle aperture or apertures, and a compressed-air conduit for supplying compressed air to said second nozzle aperture or apertures and for supplying compressed air via a controlled valve to said compressed-air-controlled pump.

8. Machine according to claim 7, further comprising:

an adjustable reducing valve situated in said compressed-air conduit upstream of said controlled valve;

a conduit for conveying compressed air to said atomizing nozzles;

a branch compressed-air conduit provided downstream of said controlled valve in the compressed-air conduit to the pump, said branch conduit leading via a non-return valve to the compressed-air conduit for the atomizing nozzle; and a restricted orifice or throttling device in said compressed-air conduit for conveying air to said atomizing nozzles.

9. Machine according to claim 7, further comprising a throttling device in the conduit leading to the compressed-air controlled pump.

* * * * *